US006343755B1

(12) United States Patent
Barclay et al.

(10) Patent No.: US 6,343,755 B1
(45) Date of Patent: Feb. 5, 2002

(54) TIRE SHREDDING MACHINERY

(76) Inventors: Randel L. Barclay, 3164 Loomis Rd., Stockton, CA (US) 95205; Mark T. Diemunsch, 262 N. Hewitt Rd., Linden, CA (US) 95236

( * ) Notice: Subject to any disclaimer, the term of this patent is extended or adjusted under 35 U.S.C. 154(b) by 0 days.

(21) Appl. No.: 09/539,981

(22) Filed: Mar. 31, 2000

(51) Int. Cl.[7] ..... B02C 18/18

(52) U.S. Cl. ..... 241/236; 241/294; 241/295; 241/DIG. 31

(58) Field of Search ..... 241/236, 294, 241/295, DIG. 31, 194

(56) References Cited

U.S. PATENT DOCUMENTS

| | | | | |
|---|---|---|---|---|
| 673,768 A | * | 5/1901 | Fleming | 241/295 |
| 3,679,246 A | * | 7/1972 | Bloomquist et al. | |
| 3,931,935 A | | 1/1976 | Holman | |
| 3,946,474 A | | 3/1976 | Hahn et al. | |
| 4,374,573 A | | 2/1983 | Rouse et al. | |
| 4,560,112 A | | 12/1985 | Rouse et al. | |
| 4,776,249 A | | 10/1988 | Barclay | |
| 4,854,508 A | | 8/1989 | Dicky | |
| 4,901,929 A | | 2/1990 | Barclay | |
| 5,100,069 A | | 3/1992 | Barclay | |
| 5,152,469 A | | 10/1992 | Dicky | |
| 5,240,192 A | | 8/1993 | Tilby et al. | |
| 5,730,375 A | * | 3/1998 | Cranfill et al. | 241/294 |
| 5,819,825 A | | 10/1998 | Lyman et al. | |
| 5,857,506 A | | 1/1999 | Paolone | |

* cited by examiner

*Primary Examiner*—Mark Rosenbaum
(74) *Attorney, Agent, or Firm*—Thomas Schneck

(57) ABSTRACT

In rotary tire shredding machinery, cutter assemblies are built onto opposing rotary shafts timed together by meshed teeth of two gears, with spacer groups separating adjacent cutter assemblies, allowing two sets of cutter assemblies to intermesh, with cutter assemblies on one shaft interleaving with cutter assemblies on a parallel shaft in a shearing relationship. Each cutter assembly has a construction featuring a series of cutter sectors, with each sector having a separately demountable knife base, with a removable, radially outward knife top. Alternate spacers between cutter assemblies are segmented, with alignment rods running parallel to the axially rotating drive shafts, passing through both the knife bases of the cutter assemblies, spacers, retaining flanges and fixed registering spacer. The rods are secured at opposite ends and the center holding the cutter assemblies and spacers in place, but when pulled, allowing the cutter and spacer assemblies to be removed from the shaft. The knife tops, which experience the most wear may be easily removed for routine maintenance, since they are held in place by radially endwise bolts, but the knife bases if they are worn or damaged may also be removed and replaced by pulling the alignment rods. Some spacers are formed in halves which are offset from each other and welded for extra strength. Spacers and cutter sectors may be assembled and disassembled in-situ on a drive shaft without removing the drive shaft from its support bearings.

20 Claims, 9 Drawing Sheets

TIRE SHREDDING MACHINERY

TECHNICAL FIELD

The invention relates to machinery for the reduction of tires to small pieces and in particular to a tire shredding machine with rotary cutter assemblies which are stronger, more easily sharpened, and which can be assembled, repaired and replaced in-situ on a drive shaft.

BACKGROUND ART

In U.S. Pat. No. 3,931,935, M. Holman teaches a method of cutting tires using cutting wheels which intermesh with other wheels of similar dimensions, using shearing action between the intermeshing wheels as the cutting force. Holman realized that because of the toughness of tires, the outer surface of the cutting wheels would be worn. In FIG. 5 of his patent, Holman shows a cutter wheel with a sawtooth shaped outer peripheral surface. To this outer peripheral surface, strips of chrome alloy tool steel are attached. The length of each strip is greater than the length of the chordal segment on the outer peripheral surface of the disk, creating a shingling effect. An advantage of using the strips is that they can be removed, repaired and replaced after becoming worn.

The shearing wheels shown in the Holman patent are mounted on shafts with multiple wheels spaced apart from each other at precise intervals. A first set of wheels on a first shaft is spaced apart from a second set of wheels on a second shaft. The two shafts have interleaving wheels, with the interleaving distance set by spacers. The two shafts are spaced from each other a distance so that edges of the wheels pass each other, coming very close at each side, so that a shearing relation exists between the first and second sets of wheels. The "cutting" of tires into reduced size pieces is achieved by shearing done by wheel edges, mainly near the radial outer periphery of the wheel, involving the outer peripheral side and top wall surfaces where most of the wear of this equipment would occur.

FIGS. 6 and 7 of the Holman patent show disks with spiked gear edges are mounted on shafts and laterally spaced apart a distance which allows the disks to act as stripper rolls in spaces below the interleaving wheels so that there is a double interleaf. First, opposed cutter wheels interleave with each other. Secondly, opposed cutter wheels interleave with stripper rolls. The function of the stripper rolls is to remove strips of sheared tires, usually about 6 to 42 inches in length and 6 inches in width. Since it is desirable to achieve a greater size reduction than this dimension a secondary set of cutter wheels, i.e. a secondary shear, follows the primary set, i.e. a primary shear, with both sets having a similar cutting action. The secondary shear reduces the 6 to 42 inch pieces to smaller pieces. In some situations even further reduction is achieved with a tertiary shear.

FIGS. 1 and 2 herein show a typical tire reduction system as used today. A continuous feed of tires, 15, is placed on conveyor belt 10 for motion toward the primary shear 11. A toothed feeder wheel 13 seizes tires from the conveyor belt and pushes them into the primary shear 11. Stripper wheels are not shown. The primary shear, relying on cutter wheels 17 and 19, reduces full tires to 6–42 inch strips 21, which are typically 6 inches wide, and a second conveyor belt 20 moves the tires to secondary shear 23. Here, a pair of rotary cutter wheels 26 and 28, mounted within box 27, held by support rails 29, receives the various length strips from bin 25. The secondary shear 23 reduces the pieces to 2–4 inch pieces 32 falling onto conveyor belt 30. Electric motors 31 provide the force for driving the primary and secondary shears simultaneously in tandem.

In FIG. 3, detailed operation of a rotary shear is seen. A first cutter assembly 17 is shown meshing with a second cutter assembly 19. Each cutter assembly is mounted on a drive shaft and has shearing knives 33 mounted adjacent to an annular spacer 35, separating the cutter assembly from an adjacent cutter assembly. The annular spacer is driven by a drive shaft by key members 37. Bolts joining the annular member to the cutter assembly allow the shearing knives to be individually removed from the cutter assembly 35 for resharpening, following the teachings of U.S. Pat. No. 4,901,929 to R. Barclay. First and second sets of cutter knife assemblies mounted on respective shafts in interleaving relationship act as rotary shears for tires fed between is the assemblies in the direction of arrow A. The stripper rolls 41 and 43 clear the spaces between spaced apart shearing knives of each shearing wheel 17 and 19. Arcuate steel segments 45 and 47 in each roll are side mounted to an annular member 49 for ease of maintenance as described in U.S. Pat. No. 4,776,249 to R. Barclay.

It is known in the prior art that the widths of the cutter wheel spacers may be graduated in thickness so that when a wheel is ground on a side, its spacer may be substituted for a neighboring thicker spacer. That wheel is also ground down on a side and is substituted for a neighboring thicker spacer, and so on. U.S. Pat. No. 4,560,112 to Rouse teaches a method of sharpening cutter wheels by removing worn cutter segments, grinding lateral surfaces and then fastening the cutter segments on a next thinner one of the cutter spacers.

A problem which still exists is the maintenance of the knives and the mounting and maintenance of spacers. An object of the invention was to simplify knife maintenance when spacer maintenance was not necessary.

Another problem which exists is that multiple cutter assemblies on a drive shaft can typically weigh 15 tons. To repair such a large piece of equipment in the field is difficult because if the cutter assemblies are removed from their support structure for repair there is frequently no suitable support for field repair and the equipment must be trucked to another location. An object of the invention was to devise cutter assemblies which could be repaired in-situ, i.e. with rotary shafts in place within their support structure.

SUMMARY OF THE INVENTION

The above object has been achieved with a new knife and spacer construction for shearing wheels of a tire shredding machine wherein repair of cutter assemblies can be done in-situ. The new knife construction involves segmented knives, with each knife segment occupying a sector of a circle as in the prior art, but with each knife having a separately demountable knife base and a removable, radially outward knife top over the knife base. Having both a demountable knife base and a removable knife top allows for selective maintenance on tire cutter assemblies. The knife base is connected at its radially inward portion to adjacent spacers and to other knives by an alignment rod parallel to an axis of rotation of the knife assembly, driven by keys in the spacers that engage keyways in the shaft, while the knife top is connected to the knife base by radial fasteners. Thus, the knife tops, which experience more wear because they are in radially offset relation to each other and have upper surfaces and part of a forward surface exposed, forming a tooth, may be sharpened without removing knife bases. However, the knife bases may also be resurfaced by removing the alignment rods without moving the main drive shaft.

It is important to note that the knife assemblies are not tied to the drive shaft but to the spacer groups. The spacer construction involves different types of segmented spacers, some of which are split in halves in their direction of rotation. The split halves are offset from each other by a half length. This allows the two halves to be welded together with exceptionally strong welds, without concern for radial shrinking after cooling because of a relieved contact surface. Radial shrinking would cause a completed cutter assembly to grip the shaft tightly and when alignment rods were loosened later, clearance needed for maintenance would be absent. By providing some spacers with this welded split construction, knife assemblies and spacers are held to the drive shaft more positively, and drive the knife assemblies which are tied to the spacers.

The rotary shaft, which drives the cutter assemblies, has 6 parallel axial keyways about the shaft, which seat three types of spacers. A first spacer is a fixed registering spacer disposed in the center of the shaft and imbedded into the shaft. A second spacer is a linearly rounded segmented spacer, with each segment having a key fitting into an axial keyway of the shaft, able to pop off of the drive shaft but for alignment rods which hold the segments in place. A third type of spacer is a welded spacer with offset segments described above. This novel spacer construction is remarkably strong and is welded after the assembly of other segments and knife components. All segments have aligned holes which allow the alignment rods to pass through, from one end of the drive shaft to the other, parallel to the drive shaft. The alignment rods secure knife bases to the spacers, with the spacers being driven by the rotary main shafts by keys fitting into keyways on these shafts. The spacers should not have to be routinely removed. However, if such action becomes necessary, for example to replace badly broken knife bases which cannot be removed in-situ, all spacers, as well as the central registering spacer, may be removed from the drive shaft, without removing the drive shaft from its support structure, thereby allowing in-situ replacement of knife bases or spacers.

The entire tire shredding assembly consisting of cutter knives and spacers, all mounted over a drive shaft become more modular with the present invention. Assembly of the apparatus is easier. Note that there are no carrier wheels for the knife components. Spacers act as drivers for knife bases and knife bases act as carriers for knife tops.

BRIEF DESCRIPTION OF THE DRAWINGS

FIG. 7 is to show how wide center knives can be ground to the next narrowest width and moved toward the end of the shafts.

BEST MODE FOR CARRYING OUT THE INVENTION

Figure 1:
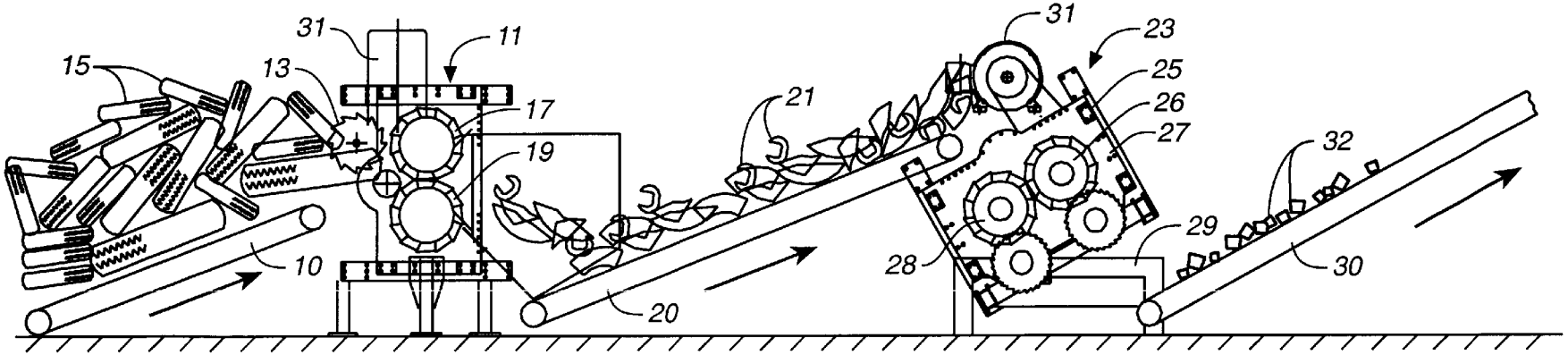
FIG. 1 (PRIOR ART)
FIG. 1 is a side elevational view of a tire shredding machinery of the prior art.
Figure 2:
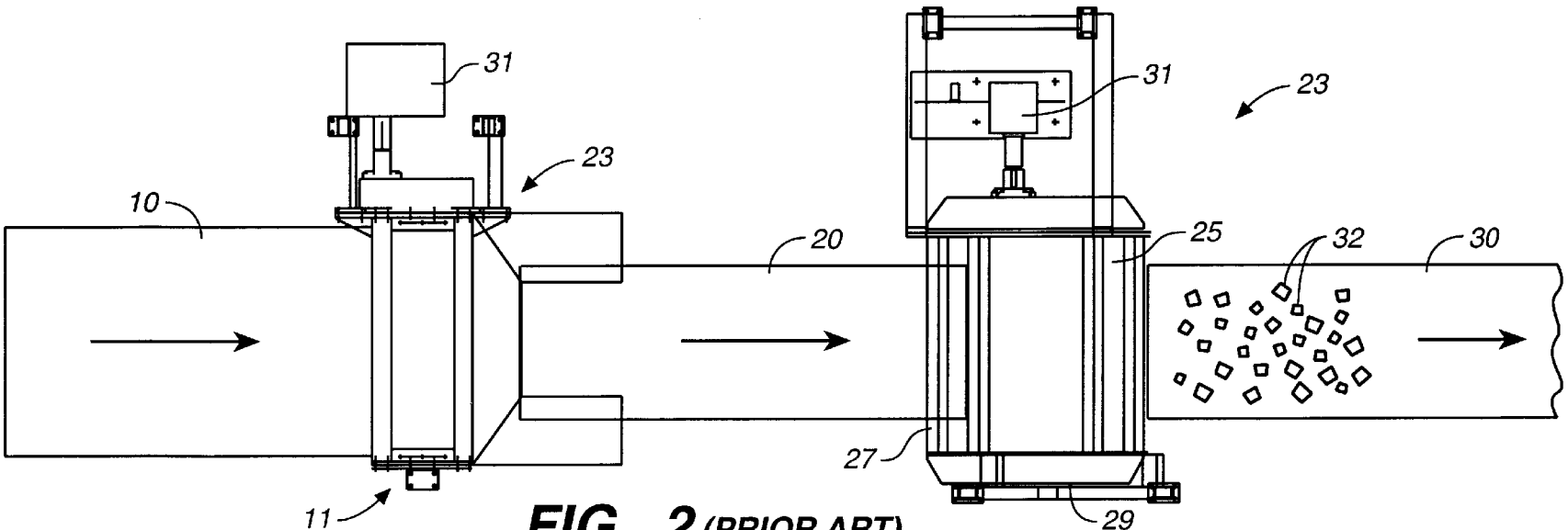
FIG. 2 (PRIOR ART)
FIG. 2 is a top plan of the apparatus of FIG. 1.
Figure 3:
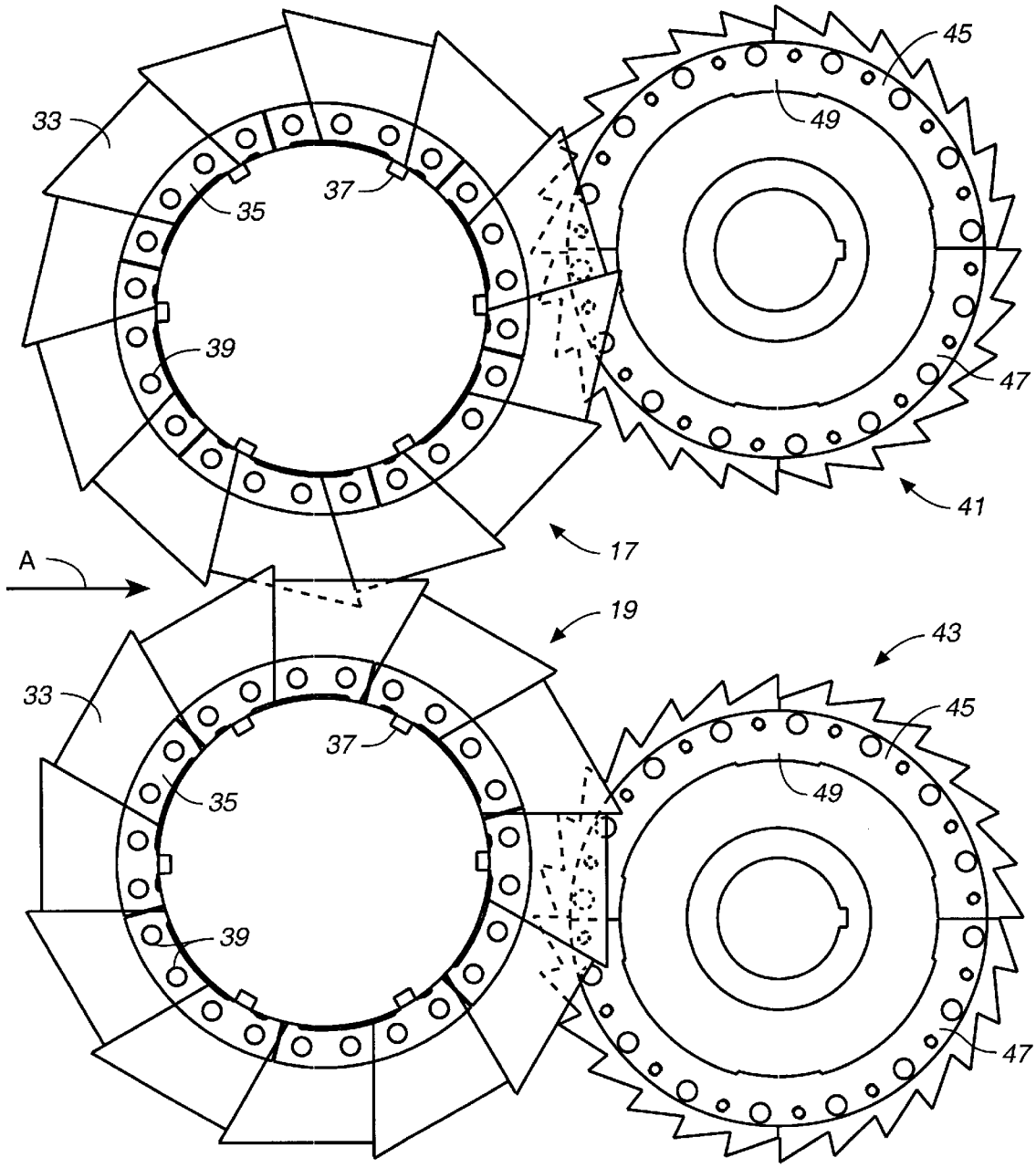
FIG. 3 (PRIOR ART)
FIG. 3 is a side diagrammatic view of a pair of cutter wheels of the prior art in an operative position with a pair of stripper rolls of the prior art positioned for removing tire comminution debris from spaces between adjacent cutter wheels.
Figure 4:
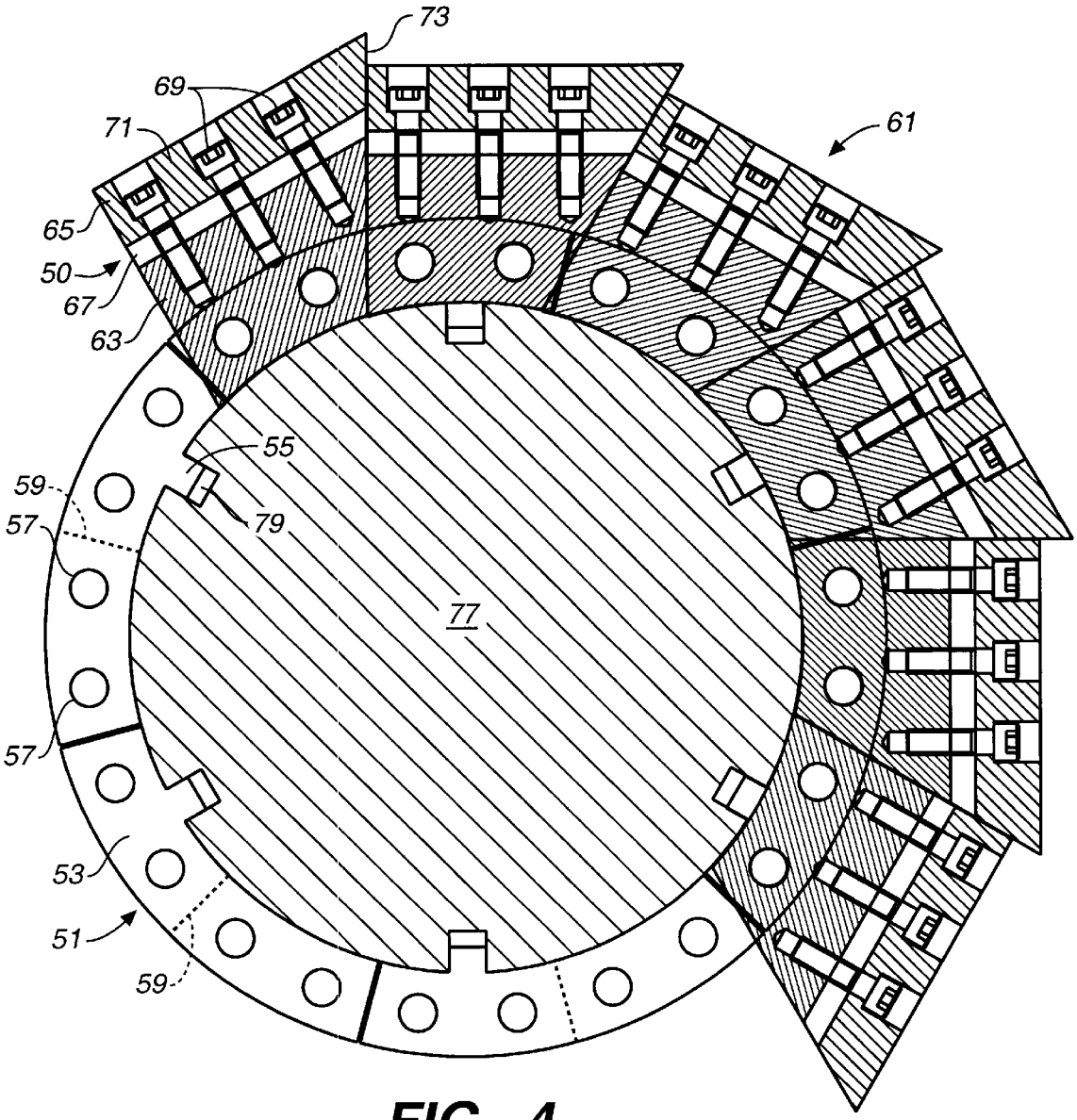
FIG. 4 is a side plan view of a cutter knife assembly in accord with the present invention.

With reference to FIG. 4, the cutter assembly 61 is seen to be formed of segmented knives 50 occupying sectors of a circle, with one knife adjacent another, in front-to-back abutting linear relation. The cutter assembly of FIG. 4 makes provision for a group of 12 knives, arranged in a circle, but more or less could be used. The group of knives is adjacent to an annular spacer group 51 which will allow an assembly of knives from another cutter assembly to pass adjacent to assembly 60 in a shearing relation whereby cutting is done by sides and edges of the knives. For this reason, the spacer ring should not extend more than about one-third the height of a knife above a common drive shaft, not shown. Both the annular spacer and the cutter assembly share the same drive shaft with the spacer assemblies connecting to the drive shaft by axial keyways in the outer periphery of the drive shaft, for example, with segment key 55.

The spacer ring 51 has a number of arcuate segments 53 to which the knives are mounted next to, using holes 57 to accommodate alignment rods which pass through the holes 57 as well as congruent holes in the knives, linking the knives to adjacent spacer rings. In other words, torque is transmitted from spacer rings to the knife group by means of alignment rods extending through holes 57. Without the rods, the arcuate segments 53 will pop off of the drive shaft in service with a slight force.

Figure 5A:
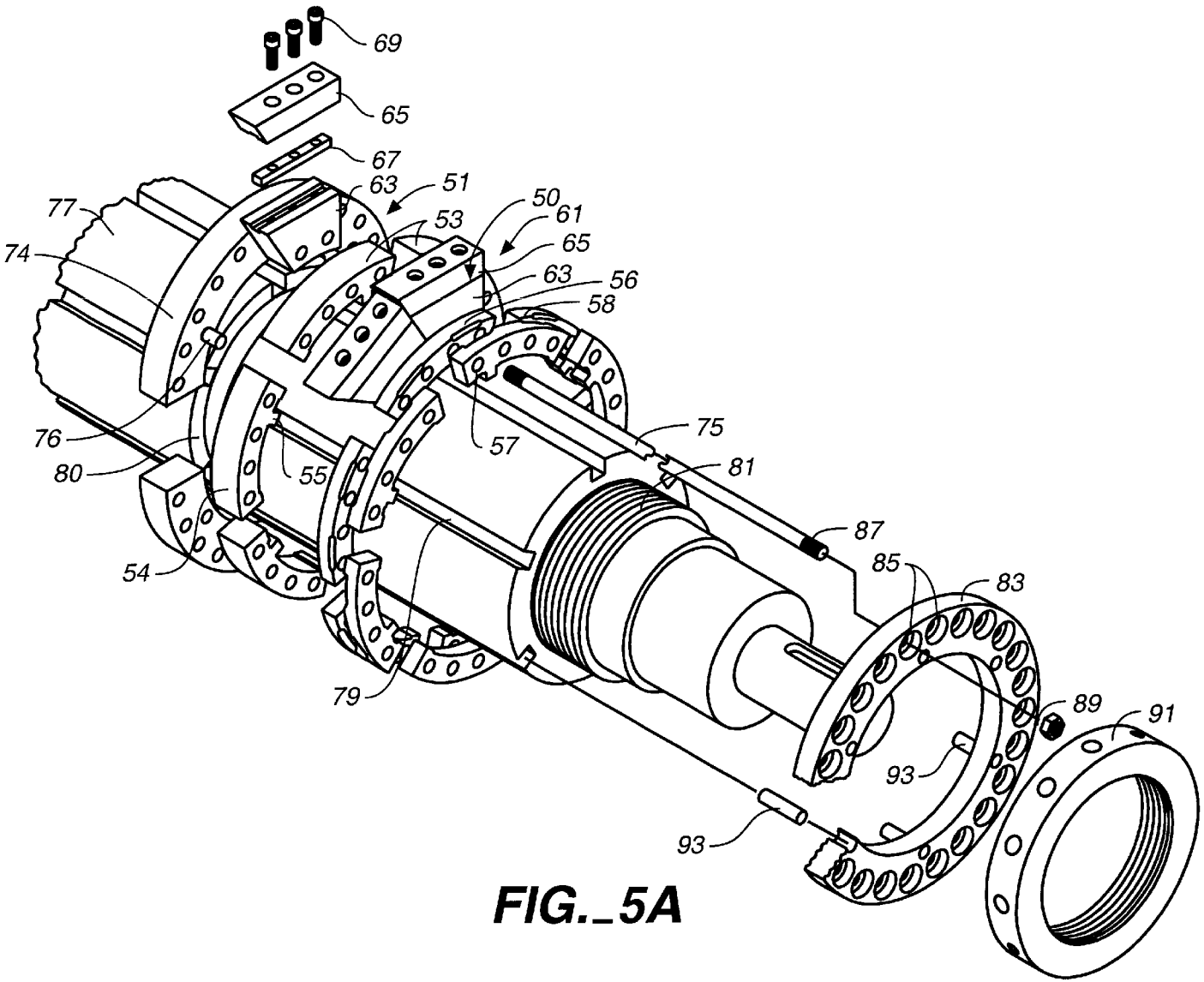
FIG. 5A is an exploded perspective view of an end region of cutter assemblies and spacer groups in accord with the present invention.

With reference to FIG. 5A, the cutter assembly 61 may be seen to have an ensemble of circumferentially spaced knives 50 tied to the spacer ring 51 by shafts 75 extending through holes 57, as described above. Each knife has a knife base 63 forming radially inward portion of the knife and a knife top 65 mounted upon the knife base and aligned to the base with a blade key 67, seen in FIG. 4. The blade key is a square tab, extending into and along the section line of the blade, fitting into a corresponding groove atop the section line of the base. The blade key 67 is an independent part which fits into a slot and is not a part of either the knife top 65 nor the knife base 63. Part of the slot is in the knife top and part of the slot is in the knife base. Fasteners 69 pass through the knife top and extend into the base, thereby anchoring the knife top to the knife base. The fasteners fit into recessed openings so that the knife tops have no outward protrusions. The upper knife top surface 71 is flat, except for the fastener openings, with a projecting tooth region 73 formed by the "shingle" effect of one knife top projecting over the adjacent top. The tooth region of a blade bears upon tires gripping the tire for feeding into shearing regions of cutter groups. A problem is that the top region wears away due to the toughness of tires against gripping. After use for a few hours, tire shredding will be less efficient as knife tops lose edges to wear and abrasion. In the past, it was necessary to replace an entire knife when it was worn. With the present invention, it is only necessary to replace knife tops if the projecting knife top region is worn or damaged. On the other hand, if the knife base becomes worn, the base can also be separately replaced by removal of alignment rods passing through the spacers and the knife bases. The most frequently replaced part will be the knife top since top edges are responsible for both shearing action and gripping action. The present invention allows easy replacement of knife tops, as well as bases.

Figure 5C:
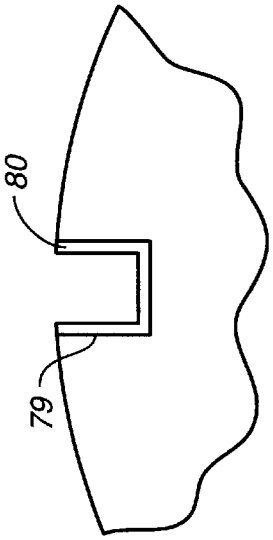
FIG. 5C is a side view detail of a keyway shown in FIG. 5B.
Figure 5B:
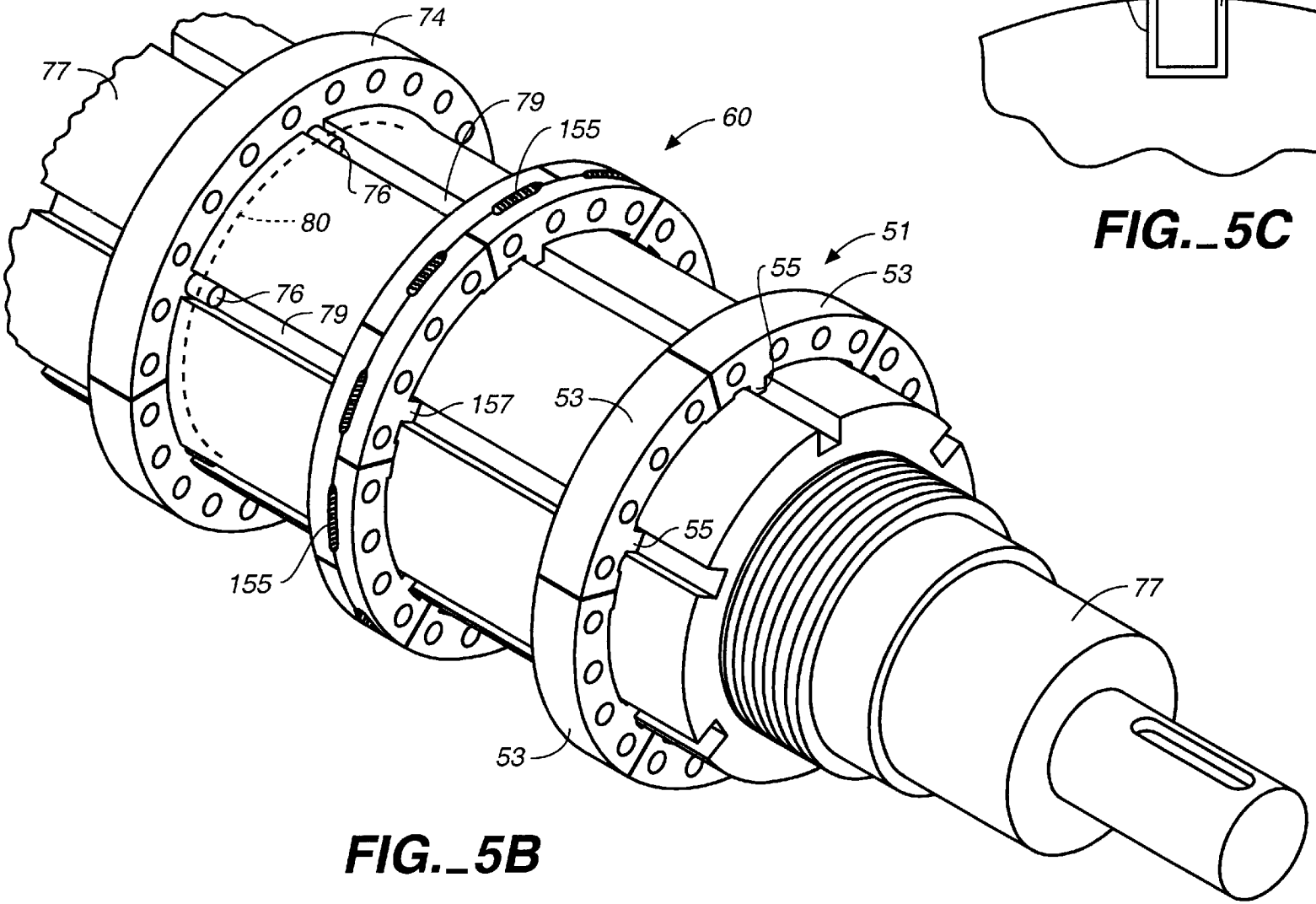
FIG. 5B is a perspective view of spacer groups of FIG. 5A, without the cutter assemblies, showing three types of spacer groups.

With reference to FIGS. 5A, 5B and 5C, the knife and spacer alignment is seen to rely on alignment rod 75 which passes through both knives and spacers, keeping the spacers positioned on drive shaft 77 and cooperatively held in a desired position by keyways 79. Alignment rods pass through fixed flanges at opposite ends of the drive shaft and a fixed registration spacer 74 at the lengthwise center of the drive shaft. The alignment rods may be removed so as to release knives and spacers for repair or replacement. With respect to knives, it is the knife tops that are of interest because the knife tops can be removed from the periphery of the cutter assembly as described above without removing the knife bases.

Some spacer rings are end-to-end segments which will pop off of the drive shaft if not kept in place by the alignment rods. Other spacer ring assemblies are each a pair of offset spacer rings, side-by-side, as described below, with reference to FIG. 8. Adjacent pairs of rings 56 and 58, are joined by welding, or otherwise, and slightly offset from each other one half-length, appearing as lateral halves of a unitary spacer assembly. The segmented structure of both types of spacers allows ease of assembly in-situ and simplicity in construction, while the offset of the halves in the welded type provides a stronger spacer ring which will not diverge from the drive shaft. While the welded type of spacer is stronger, the pop-off type is alternated with the welded type for purposes of economy.

The most common type of spacer is the rounded segmented spacer 51 having segments 53, previously described as pop-off segments. In a typical cutter assembly having 12 or more spacer groups, more than half would be of this type. This spacer rests on the outer peripheral surface of the drive shaft, with a segment key 55 in the axial keyway 79. The segmented spacers are held in place by alignment rods 75 passing through holes in the spacer. A less commonly used spacer, but one that is needed to add rigidity to the cutter assembly, is the welded spacer 60 having a plurality of mutually offset spacer portions 56 and 58. The offset portions are welded together, as described below with reference to FIG. 8, after assembly and in-situ. When the offset portions cool after welding, they fit tightly around the drive shaft, because of some radial shrinking, making the welded spacer ring much stronger, but possible, to move because the radial shrinkage in this method of welding is greatly minimized.

Each end of the drive shaft 77 is threaded, such as the threaded drive shaft end 81 to accommodate a retainer flange 83 which is capable of sliding in and out with the nut. This flange has recessed holes 85 which allow the end 87 of the alignment rod 75 to pass through the flange and receive a retaining nut 89. This is done for a plurality of alignment rods, with each rod retained by a nut after passing through the flange. The flange is aligned to the shaft by a group of pins 93 that project from the flange into the keyways of the shaft. End member 91 is screwed onto the threads of the drive shaft to cover the nuts, using threads 93 in the end member.

With reference to FIG. 5B, the shaft 77 is seen to have the three types of spacers discussed above in position, having been assembled in-situ. For ease of understanding, cutter assemblies are not shown. The fixed registering spacer 74, in the middle of drive shaft 77, is seen with two halves fitting into a circumferential groove indicated by dashed line 80. This spacer is driven and retained during assembly by pins 76 in keyways 79. The number of fixed registering spacers is limited to with the preferred location in the center, but it could also be located on either end. Another type of spacer is the linearly rounded spacer 51 having segments 53. Each segment has a segment key 55 serving to transfer torque from the drive shaft 77. The segments are readily removable from the drive shaft, i.e. they pop off of the drive shaft when alignment rods are removed. Lastly, the welded spacer 60 has offset segments joined by welds 155 and with segment keys 157 serving to transfer torque from drive shaft 77. All three types of spacer rings have holes to accommodate alignment rods passing through the holes and all three types of alignment rings are made of pieces which can be assembled in-situ. With reference to FIG. 5C, the keyway 79 and all axially parallel keyways have a case hardened one-length inch thick steel liner, protecting all three sides of each keyway. The liner is milled from square bar stock and extends the entire length of the keyway. The liner allows segment keys to abut a tough material without the need for hardening the entire rotary shaft. The liner may be replaced if damaged, without replacing the entire shaft.

Figure 6:
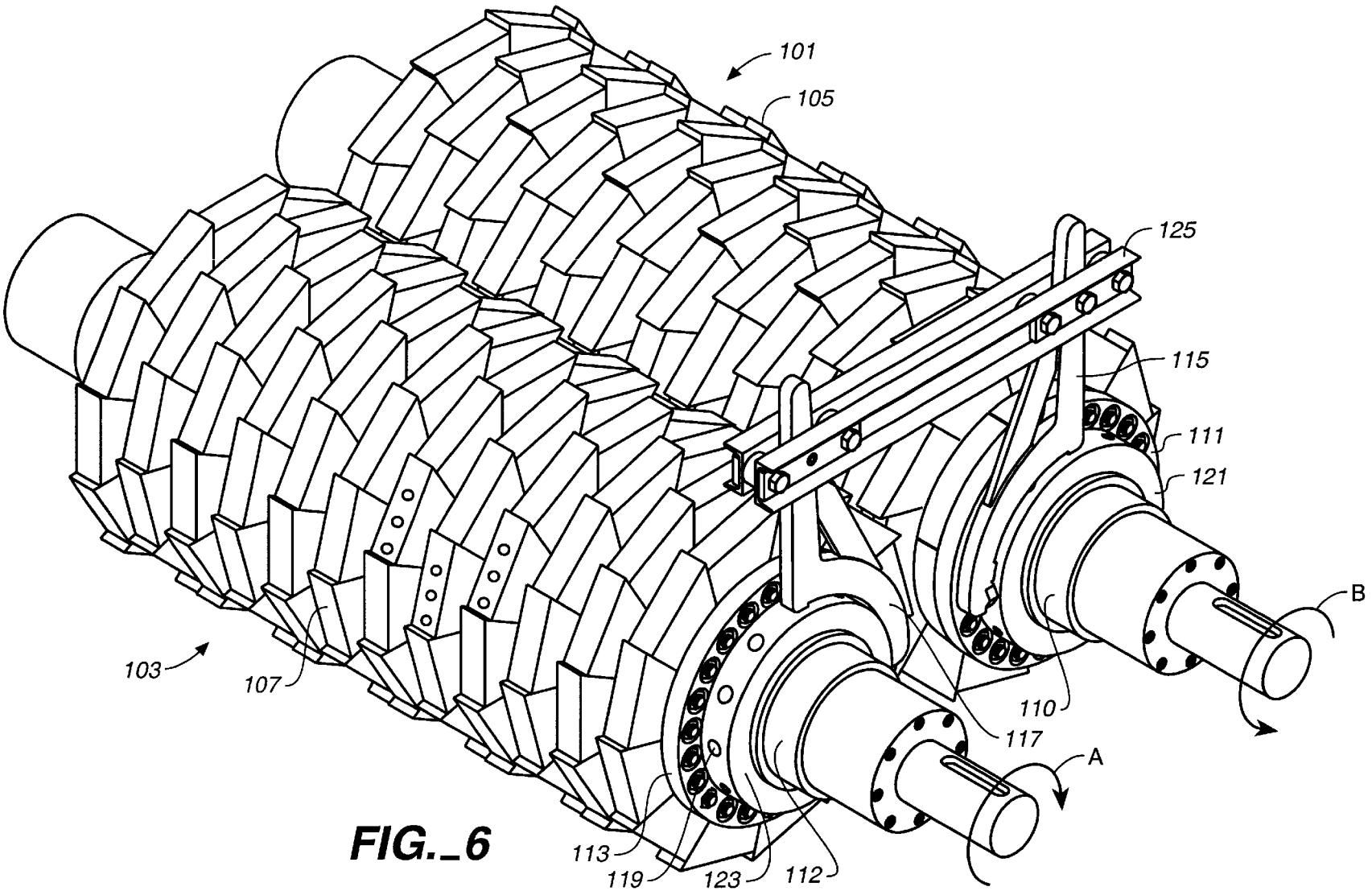
FIG. 6 is a perspective view of a pair of cutter assemblies, in tire shearing relation, with an assembly tool in place.

With reference to FIG. 6, a first ensemble cutter assemblies 101 is seen meshing with a second assembly of cutter assemblies 103 as the cutters would be arranged for shearing tires fed into the zone where the cutters come into close proximity. In particular, a single right cutter assembly 105 is seen to be in shearing relation relative to a single left cutter assembly 107, with each cutter assembly having a plurality of cutter knives, each knife having a base and a top. The bases and tops are not shown in FIG. 6. All of the cutter assemblies are mounted on respective drive shafts 110 and 112. Each cutter assembly ensemble has two retainer flanges, such as the right retainer flange 111 and the left retainer flange 113. A right internally threaded member or nut 121 and a left internally threaded member or nut 123 secures the retainer flanges in place. Each nut at either end of drive shafts 110 and 112 has radially disposed end member apertures 119 into which spanner wrenches fit. In particular, the right spanner wrench 115 grips the right end member 121 and the left spanner wrench 117 grips the left end member 123. Each spanner wrench has an elongated handle which is held in a fixed position by a spanner handle locking bar. Since the end members are threaded oppositely with right and left hand threads, turning the two drive shafts in the directions, indicated by arrows A and B, tightens the end members in place. When sufficiently tightened sacrificial bolt will shear to produce a known torque, the spanner wrenches are removed, by first removing the locking bar 125, then disengaging a spanner lug from a nut aperture. Not shown are timing gears on the drive shafts which cause the cutter assemblies on different shafts to rotate into each other.

Figure 7:
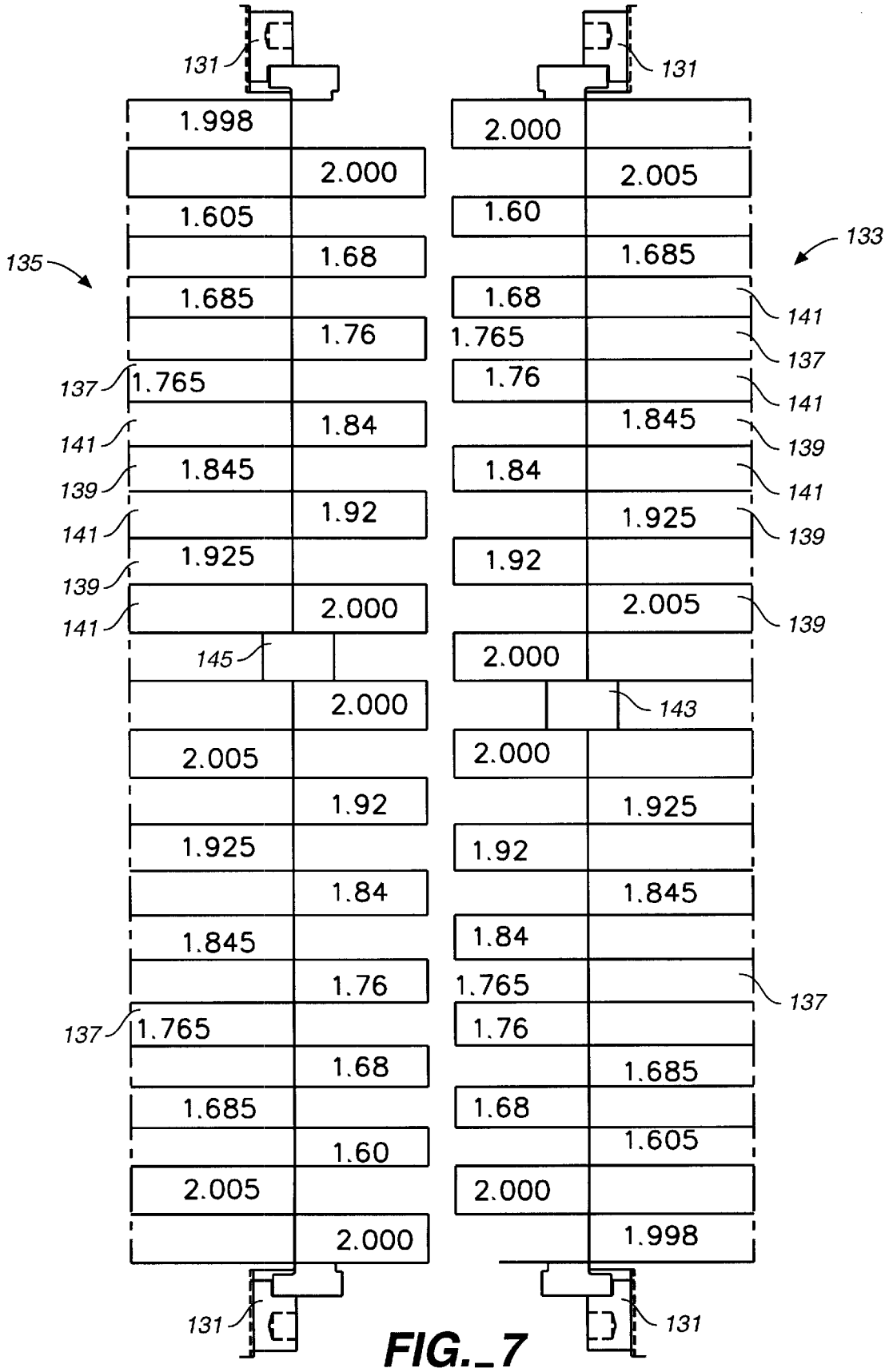
FIG. 7 is a top plan view of a pair of cutter assemblies of the present invention, showing cutter and spacer widths in inches.
Figure 8:
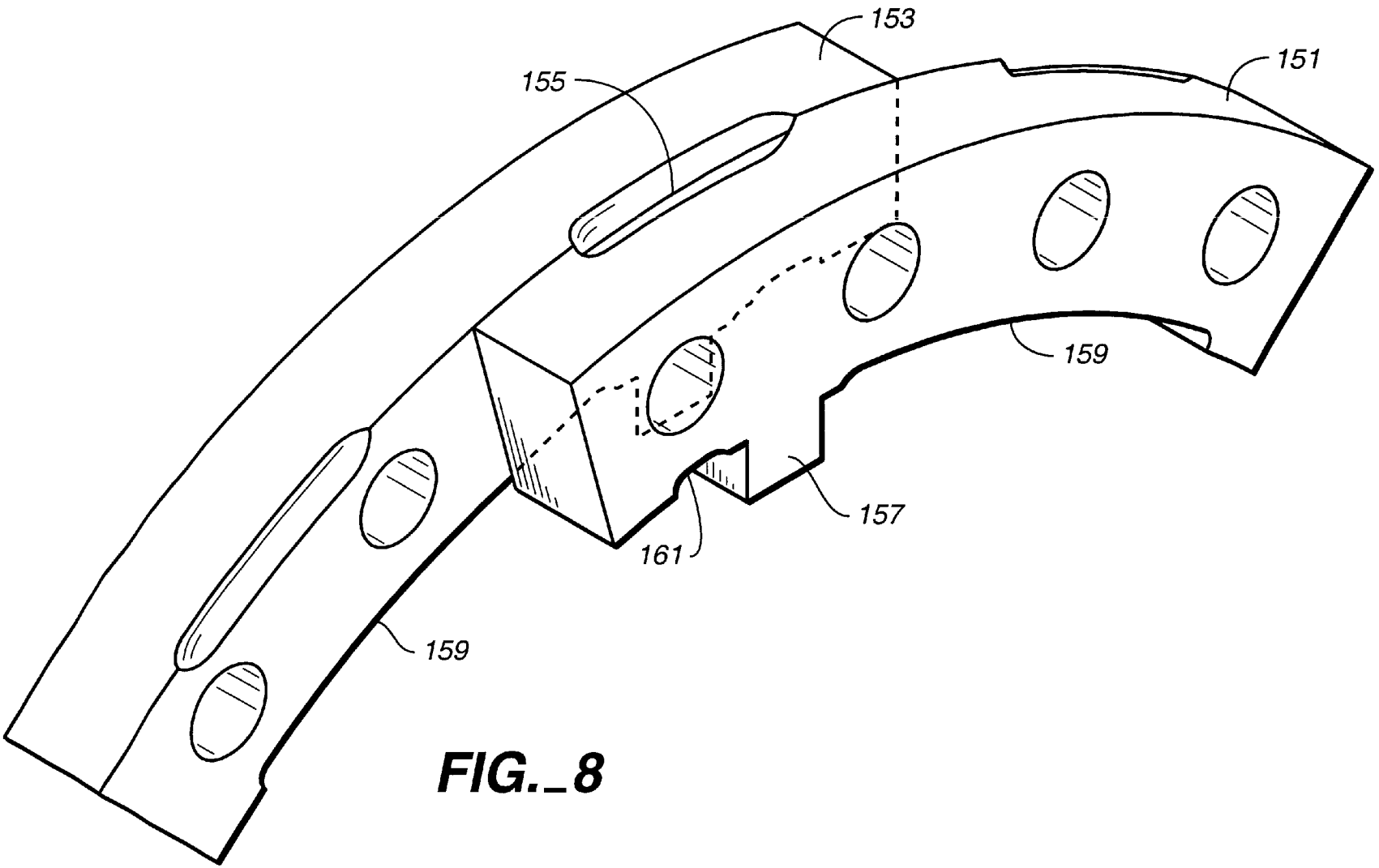
FIG. 8 is an enlarged perspective view of two offset spacer segments of a welded spacer group in accord with the present invention. The difference between FIG. 6

In FIG. 7, the thicknesses, in inches, of cutter group wheels and spacer groups is shown for one particular configuration of knives and spacers. Cutter ensemble supports 131 mount the right cutter wheel ensemble 133 and the left cutter wheel assembly 135. There are three types of spacers which are used. Fixed welded spacers 137, shown in FIG. 8, are mounted at spaced intervals on the drive shafts. Between most of the cutter assemblies 141 are moveable spacers 139, shown in FIG. 5. The thickness of the cutter assemblies is seen to be graduated. When the sides of a cutter wheel consisting of a knife base and knife top are ground for sharpening, the cutter wheel which is ground is moved in its shaft position to another position where a cutter wheel of the new dimension is needed. This means that all knifes should be sharpened at the same time, or a number of spares maintained. The thickness of the thickest knife assembly is 2.000 inches, while the thickness of the thickest spacer is 2.005 inches. Upon grinding the sides of a knife assembly, the thickest cutter assembly is replaced and each ground assembly is moved to a position of a thinner group. In other words, the wide center knives are ground to the next narrowest width and moved towards the end of the shafts. The amount of grinding is carefully controlled so that the resulting group will have a thickness corresponding to the thickness of an available position. Lastly, central registering spacers 74 are of a type shown in FIGS. 9A and 9B and have a groove machined into the shaft to accept them.

As mentioned with reference to FIG. 5, the fixed spacers, like the other spacers, are segmented and welded in a ring. FIG. 8 shows that segments of the spacers are offset from each other. For the purpose of joining segments into a solid ring by a radially shrinkless welding method, the first segment 151 laterally overlaps half of the second segment 153. A groove 155 between the two segments will accept weld deposited metal and is the location for a weld joining the two segments. A flush weld is formed. Key 157 locks the spacer to the drive shaft. Spacers which are segmented, but not offset, may tend to pull away from the drive shaft. By offsetting the spacer segments and welding into a slid continuous ring that will still slide laterally, a more robust solid ring is formed circumscribing the shaft. This type is spacer is used intermittently among the movable spacers. The spacer segments are hardened by heat treating which can cause slight deformations of the inside radius of the segment, creating a small pivot spot against the shaft. By relieving the inside portions of the segments, most of the inside radius of each segment is away from the shaft so that good contact with the shaft is made only by end portions of each segment and by the key.

Figure 9B:
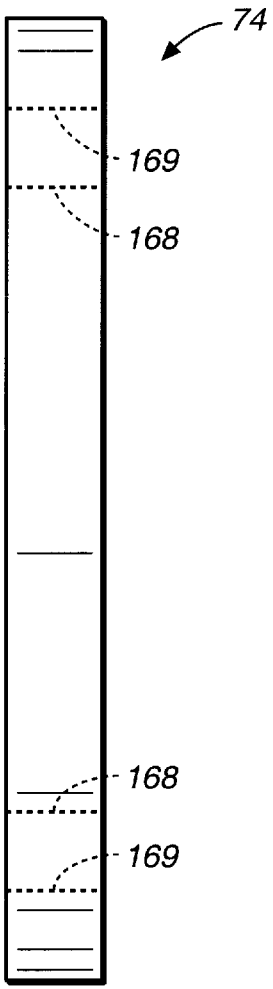
FIGS. 9A and 9B are front and side view of a registering spacer shown in FIG. 5B.
Figure 9A:
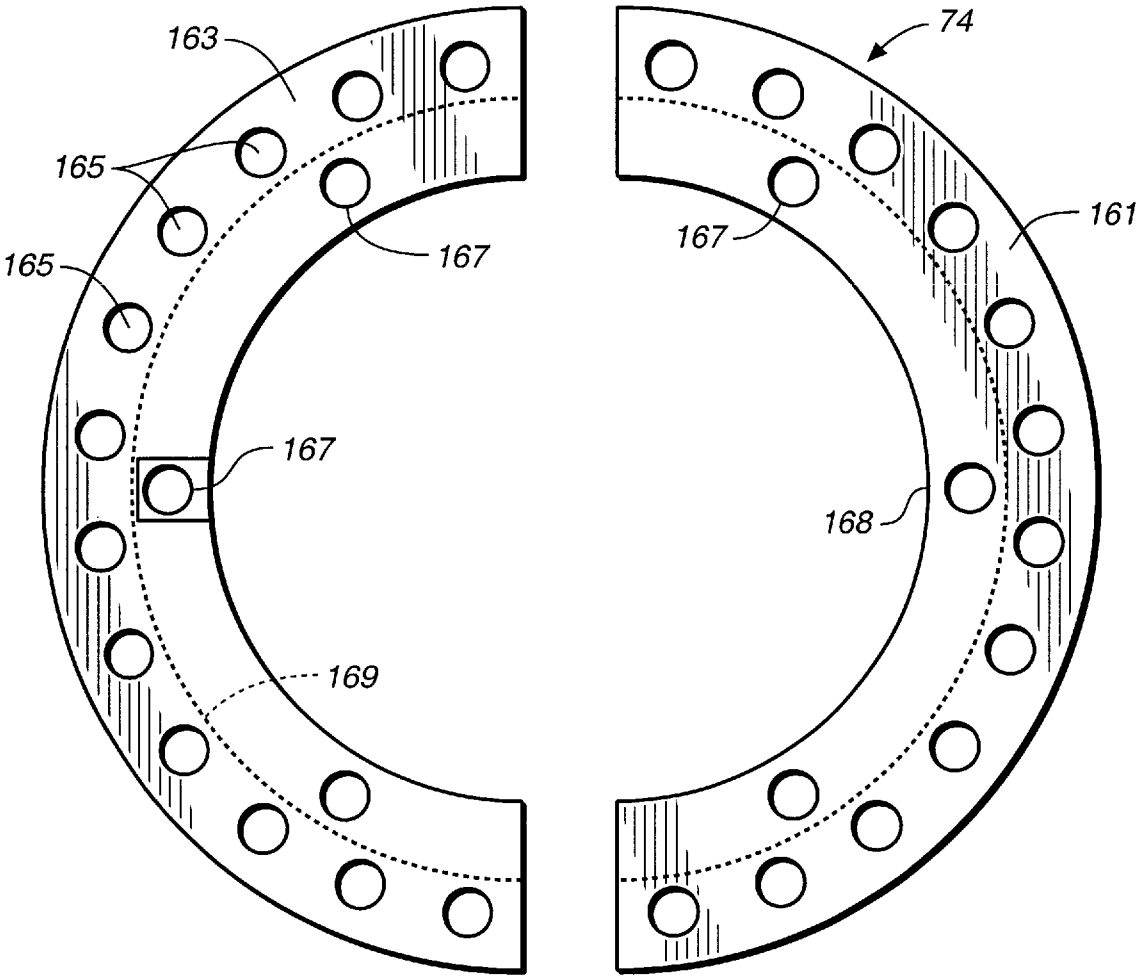

In FIGS. 9A and 9B the fixed registering spacer 74 is seen to have two halves 161 and 163, each semicircular. Approximately half of the radial extent of each spacer half is intended to reside in a groove of rectangular cross section cut into the periphery of the drive shaft. A dashed line 169 indicates the portion of the spacer which resides in the groove on the shaft. The spacer does not contact the bottom of the groove because the groove is made deeper than the inside radius 168 to accommodate a small amount of particulate matter which may fall into the groove. Holes 167 are radially inward of dashed line 169, placing the holes in a subsurface position relative to the drive shaft. Projecting pins are placed into the holes 167 so that the drive shaft will positively locate and turn the spacer. Holes 165, above the dashed line 169, exist so that the alignment rods can pass through the fixed spacers, which also act as a central locator for the alignment rods.

What is claimed is:

1. A rotary shearing wheel assembly for tire reduction machinery comprising, a shaft, having an axis, connectable to a source of rotary power, a plurality of spaced apart, round, shearing assemblies axially disposed on the shaft, each shearing assembly having a plurality of radially adjacent knives, each knife occupying a sector of a circle and having a knife base removably connected to the shaft and to a radially outward top knife, with sectorally adjacent knives forming a knife assembly, each knife being in radially offset relation to each other, leaving the outwardmost surface of the top knife exposed, whereby knife tops may be removed from knife bases for repair or replacement, a plurality of elongated keys, each key disposed between the knife base and the knife top and seated in opposed slots, one slot defined in the knife base and one slot defined in the knife top, and a plurality of spacer groups removably connected to the shaft in positions between shearing knife assemblies, the radial extent of the spacer group being less than the radial extent of the outward surface of the knife assemblies.

2. The apparatus of claim 1 wherein the knife tops are connected to the knife bases by radially extending bolts.

3. The apparatus of claim 1 further comprising an alignment rod passing through all knife bases, holding the bases in alignment.

4. The apparatus of claim 1 wherein at least some of the spacer groups are segmented.

5. The apparatus of claim 4 wherein at least some of the segmented spacer groups have offset halves joined into a solid ring by welding in assembly or in-situ.

6. The apparatus of claim 1 wherein the rotary shaft has parallel keyways parallel to the axis of the shaft and said keyways have a hardened liner and wherein the spacer groups have keys which engage said keyways.

7. A round shearing knife group having an axially driven rotary shaft for tire reduction machinery comprising, a plurality of knife bases, each base forming a truncated radial sector of the cutter group, with a plurality of knife bases, disposed in a pie configuration, forming a round cutter group, a plurality of elongated alignment rods, each rod passing through a base, parallel to the axially driven shaft, a plurality of knife tops, each top removably supported atop a knife base, radially outwardly from the knife base, a plurality of elongated keys, each key disposed between the knife base and the knife top, and seated in opposite slots, one slot defined in the knife base and one slot defined in the knife top, and a registering spacer fixed to the axially driven shaft providing alignment for the alignment rods.

8. The apparatus of claim 7 wherein said plurality of knife bases are mounted on the axially driven shaft.

9. The apparatus of claim 7 wherein a pair of spacer groups are disposed on each side of a cutter assembly.

10. The apparatus of claim 9 wherein said axially driven shaft has keyways parallel to the axis of the axially driven shaft, with said spacer groups having segment keys engaged with the keyways.

11. The apparatus of claim 9 wherein at least some of the spacer groups are segmented.

12. The apparatus of claim 11 wherein the segmented spacer groups have offset halves joined together by welds into a ring.

13. The apparatus of claim 9 wherein each spacer group has said alignment rods passing therethrough.

14. The apparatus of claim 7 wherein the knife bases are in radially offset relation to each other.

15. The apparatus of claim 14 wherein the knife tops are in radially offset relation to each other, leaving the radially outwardmost surface of each surface knife top exposed.

16. The apparatus of claim 7 wherein the knife tops are secured to the knife bases by radial fasteners extending from a radially outward position of each knife top into a supporting knife base.

17. A rotary segmented shearing wheel assembly for tire reduction machinery comprising, a pair of shafts connected by timing gears, having an axis, connectable to a source of rotary power, a plurality of spaced apart shearing knife assemblies axially disposed upon the shaft, each shearing assembly having a plurality of radially adjacent knives, each knife occupying a sector of a circle, with sectorally adjacent knives each being in radially offset relation to each other, leaving the outwardmost surface of the knife assembly exposed, a plurality of spacer groups, some spacer groups removably connected to the shaft in positions between shearing knife assemblies, the radial extent of the spacer groups being less than the radial extent of the outward surface of the knife assemblies and some spacer groups being segmented and having offset halves joined together by welding, and a plurality of elongated rods disposed at intervals around the axial shaft and parallel thereto, the rods passing through both the shearing knife assemblies and the spacer groups in a removable manner, the rods having end members securing the shearing knives and spacer groups in place, the shearing knife assemblies and spacer groups being removable from the shaft when the rods are removed.

18. The apparatus of claim 17 wherein each shearing knife group has a plurality of radially adjacent knives, each knife occupying a sector of a circle and having a knife base removably connected to the shaft and to a radially outward top knife.

19. The apparatus of claim 18 wherein the knife tops are connected to the knife bases by radial bolts.

20. The apparatus of claim 17 wherein spacer segments are offset by half of their length.

* * * * *